US005385254A

United States Patent [19]

Hannon

[11] Patent Number: 5,385,254

[45] Date of Patent: Jan. 31, 1995

[54] EASY LIFT CONTAINER OPENING

[76] Inventor: Charles N. Hannon, 27 Sargent Rd., Scarsdale, N.Y. 10583

[21] Appl. No.: 104,357

[22] Filed: Aug. 9, 1993

[51] Int. Cl.[6] ..... B65D 17/32

[52] U.S. Cl. ..... 220/269; 220/270

[58] Field of Search ..... 220/269, 268, 270

[56] References Cited

U.S. PATENT DOCUMENTS

| | | | |
|---|---|---|---|
| 4,148,410 | 4/1979 | Brown | 220/269 |
| 4,150,765 | 4/1979 | Mazurek | 220/269 |
| 4,276,993 | 7/1981 | Hasegawa | 220/269 |
| 4,289,251 | 9/1981 | Maliszewski | 220/269 |
| 4,821,912 | 4/1989 | Wells | 220/231 |

*Primary Examiner*—Gary E. Elkins
*Assistant Examiner*—Vanessa Caretto
*Attorney, Agent, or Firm*—Israel Nissenbaum

[57] ABSTRACT

The top of a metal beverage container, opened with a non-removable fulcrum-type lift tab, is modified, by the inclusion of a shallow channel, in order to facilitate initial lifting of the tab. The channel is positioned directly adjacent the pushing end of the tab and configured such that operative lifting of the tab causes the pushing end of the tab to fit within the channel and into pushing engagement with the container top at the base of the channel. The channel is configured into mirrored conformity with the pushing end of the tab, with the depth of the channel conforming to the shape of the pushing end of the tab to maintain full pushing engagement. The initial engagement of the lift tab with the channel results in a delay in container top opening and substantially less lifting pressure being needed to elevate the tab end for a finger to be more easily inserted for completion of the opening of the container. The maximum depth of the channel is such that it does not perceptibly impede container top stacking or prevent opening of the container.

9 Claims, 3 Drawing Sheets

EASY LIFT CONTAINER OPENING

FIELD OF THE INVENTION

This invention relates to easy lift opening of metal beverage containers having non-removable fulcrum type lift tabs.

BACKGROUND OF THE INVENTION

Beverage containers such as soda or beer cans are currently marketed with self contained openers in the form of lift tabs. In all of the present embodiments, the lift tab is comprised of a ring portion for control by an inserted finger. In one form of lift tab, the ring is attached to a pear shaped prescored section of the container top, with continued lifting of the ring causing the pear shaped section to become completely detached from the container top. This type of lift tab has however met with an environmental outcry since it has resulted in a new type of litter. Accordingly, a more acceptable non-detachable lift tab is presently being utilized on nearly all of the soda and beer cans currently sold in the United States, with the soda and beer cans being themselves recycled to reduce litter.

The non-detachable lift tab, with some design variations, is basically comprised of a short, somewhat rectangular, elongated aluminum strip (about 1×9/16 inch—25×16 mm) with rolled over edges for structural strength and for prevention of exposed sharp edges. There has been a tendency to reduce the dimensions of the tab to save on material costs.

At a first end, the tab is formed into a ring-like member (also with rolled over inner edges) for finger insertion and lifting. The second end, with strengthened rolled over edge, is rounded or tapered (with some tabs the pushing end is a straight edge) and crimped for force-concentrated pushing engagement with a cantilevered weakened section of the container top, which will open upon continued application of pressure. To facilitate manufacture and container storage nesting, the usually circular container top is shallowly dished along a major portion of a diameter thereof. About half of the length of the dished area is formed for seated mating with the lift tab, i.e slightly larger but conformed to the peripheral shape of the lifting end and adjacent sides of the lifting tab. The center of the container top, situated within the dished area, is formed with an outwardly extending hollow rivet-like section which fits into a corresponding aperture located on the longitudinal axis of the tab. The aperture is positioned on the tab such that the engagement between tab and container top results in about three quarters of the length of the tab (the lifting end) being situated on one side of the engagement site and about one quarter of the tab (the pushing end) being situated on the other side. The rivet-like section is then peened over, during assembly, to fixedly attach the lift tab to the container top.

The remaining dished area in the container top contains a weakening score line in the shape of a thumb nail (other design related shapes include truncated ovals or circles) having its tapered (or arced) end extending in a direction opposite that of the tab. A small portion of the "thumb nail", peripherally adjacent to the engagement site, however remains unscored. The pushing end of the tab extends over the non-scored portion and over the adjacent area enclosed by the thumb nail score line. During the opening operation, the lifting end of the tab is elevated. The tab pivots through the rivet engagement area and the pushing end of the tab swivels down thereby tearing and pushing the weakened area of the container top into the container. Because of its proximity to the pushing end of the tab, the scored area, adjacent the rivet-like section, tears open first, with initial internal gas pressure relief (the contained beverages are usually carbonated or are susceptible to internal gas evolution). Upon continued pushing pressure, the tear propagates around the score line away from the pushing end of the tab. The section of the container top, enclosed by the score line, then pivots down into the container in a cantilevered movement, and is held from falling into the container by the small unscored section of the "thumb nail". The area surrounding the contact point between the tab end and the container top is strengthened by a raised rib integrally formed within the "thumb nail" area to prevent gouging of the container top by the tab end.

In order to prevent detachment or breakage of the tab, at the peened over portion, the tab itself is partially circumferentially lanced or slotted around the engagement site. The lance line or slot extends from the lifting end of the tab to equidistant points just beyond the peened over engagement site and on both sides thereof. The partial circumferential lance line or slot also slightly overlaps the thumb nail score of the container top. The connecting line between the ends of this lance line or slot defines the pivoting or fulcrum line (slightly removed from the peened over rivet section) for the pushing end of the tab and all the pivoting or fulcrum pressure is concentrated on this pivoting line. Initial lifting of the tab through the pivoting line is relatively strongly resisted by engagement of the pushing end of the tab with the container top and the pressure required to open the score line in the container top. Such resistance is even greater if the contents of the container are also pressurized. In addition, the increased tendency toward shorter tabs has reduced the leverage of the tab with concomitant increase in resistance to lifting.

This relatively high resistance results in significant consumer inconvenience particularly since the lifting end of the tab is near the obstructing raised edge of the seal between the container top and the container. In addition, access to the tab is further obstructed by the tab being slightly lowered into the dished area of the container top. Insertion of a finger for lifting the tab is impeded and the small purchase area initially available is resisted by the relatively high resistance with the very real likelihood of fingernail breakage. Such resistance is, of course, negligible if the full finger can be utilized for lifting. In order to obviate this problem some lift tabs are provided with an elevated ring tab. However, the degree of elevation is limited by increased difficulty in manufacturability and the fact that the container tops are designed to be stacked for storage and production line feeding. Thus, an overly elevated tab will either be bent or will impede proper stacking and such elevation cannot be more than about ⅛ of an inch (3 mm) whereas about ¼ inch (6 mm) is required for effective finger purchase on the lifting end of the tab. Other means for providing the initial lift for full finger purchase include the use of coins, keys and special tools which are small enough to be inserted under the tab and then used as small levers.

It is noted that the previously used detachable (but environmentally objectionable) tab offered little or no resistance pressure to moving the tab into a perpendicular position, for full finger grasp, prior to the lifting off opening.

SUMMARY OF THE INVENTION

It is an object of the present invention to provide a means, integral with the container, for facilitating opening of a container having a non-detachable fulcrum type lift tab.

It is a further object of the present invention to provide such means by economically modifying the container top structure to permit upward movement of lift end of the tab with reduced pressure required to lift the tab to a desired height sufficient for full finger purchase, without affecting tab opening reliability.

It is a still further object of the present invention whereby modification of the container top structure requires minimal modification of existing container production machinery and facilities.

These and other objects, features and advantages of the present invention will become more evident from the following discussion as well as the drawings in which:

SHORT DESCRIPTION OF THE DRAWINGS

Figure 3:
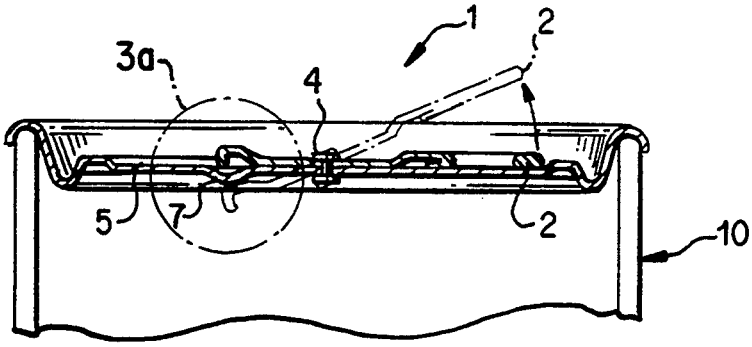
FIG. 3 is an isometric view of a container, with the top of the present invention, being opened.
Figure 5:
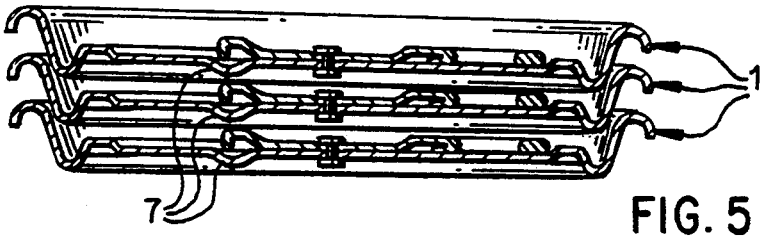
Figure 4A:
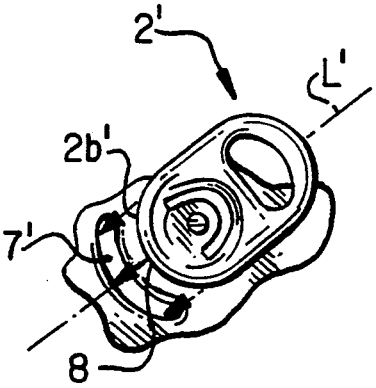
Figure 4B:
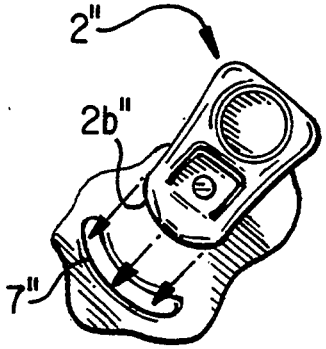
Figure 4C:
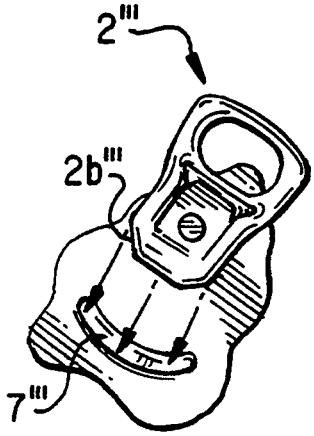
Figure 3A:
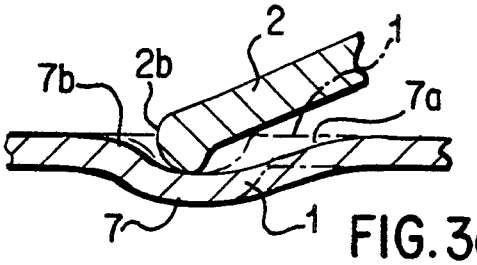
Figure 3B:
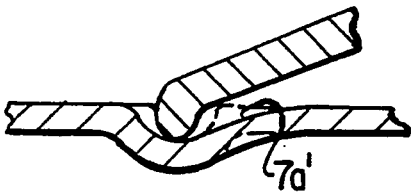
Figure 6A:
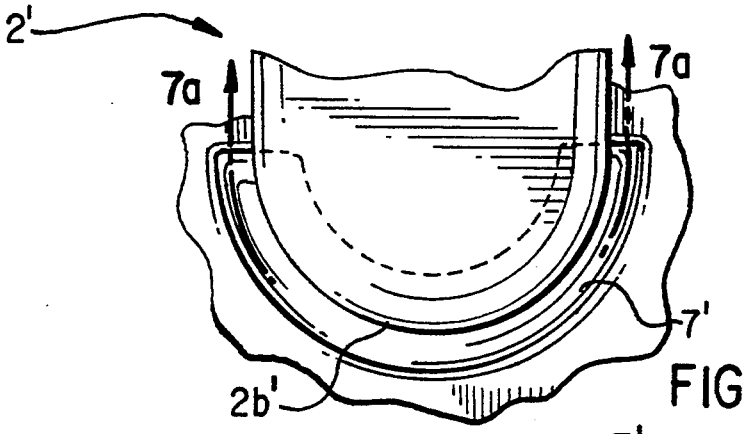
Figure 7A:
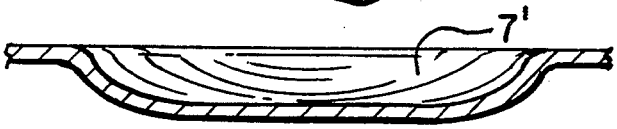
Figure 6B:
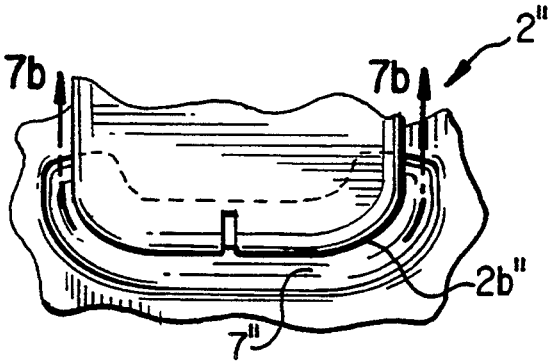
Figure 7B:
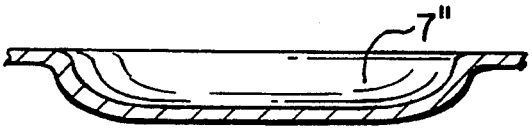
Figure 6C:
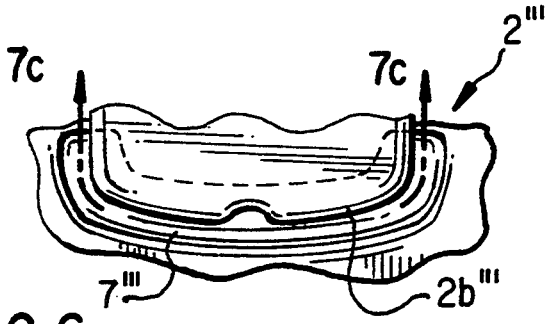
Figure 7C:
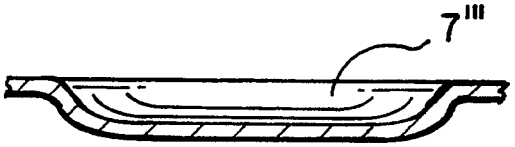

FIG. 3*a* is a cross section view along line 3*a*—3*a* of FIG. 3, showing the interior of the relief channel of the present invention;

FIG. 3*b* is a cross section view similar to that of FIG. 3*a*, showing a second embodiment with a bevelled edge reduction;

FIGS. 4*a–c* depict various combinations of tabs with respective matched pressure relief channels, in accordance with the present invention;

FIG. 5 depicts typical production line container top stacking, showing the relative positioning of the tops and the pressure relief channels of the present invention;

FIGS. 6*a–c* depict top views respectively of the tab ends and channels of FIG. 4*a–c*, respectively, after being brought together in their operative proximity; and FIGS. 7*a–c* are cross sections taken along lines A—A, B—B and C—C, respectively, of the channels in FIGS. 6*a–c* respectively.

DETAILED DESCRIPTION OF THE INVENTION

Generally the present invention comprises an improved container top for specific use with a non-detachable fulcrum type lifting tab, for opening a container. The container top and tab, in operative conjunction, embody integral means, for reducing the amount of pressure required for raising the tab from the container top, whereby a finger may be readily inserted for continued lifting and opening of the container. As described above, non-detachable fulcrum type lifting tabs have a first end for finger lifting, and a second end for pushing engagement with a scored and weakened section of the container top, with the container top being opened thereby. The tab is apertured for attachment to the container top by engagement with a rivet like section of the container top which is peened down to fixedly hold the tab in place. Elevation of the lifting end of the tab causes the tab to swivel through a pivot line, adjacent the engagement point, for opening of the weakened section of the container top (in accordance with the configuration and operation described above). However, the residual metal in the score of the container top, particularly if buttressed with pressurized container contents, relatively strongly resists the initial lifting of the tab and provides an impedance for full finger insertion under the lifting end of the tab.

In accordance with the present invention, the means for facilitating opening of the container, via the lift tab, with reduction of lifting pressure, comprises the container top being formed with a downwardly (towards the interior of the container) extending channel, positioned directly adjacent the pushing end of the tab and wherein the channel is shaped and dimensioned to fittingly engage such tab end when the tab is initially lifted. The fitting engagement provides room for the tab end to move downward toward the container, without initial engagement with the walls of the container top. This delays resisting-pressure against the tab lift, for a distance sufficient to allow for proper finger purchase. Because of the off-center riveted attachment of the tab to the container top (closer to the pushing end of the tab), a small channel depth and unimpeded tab movement translates into a relatively large lift at the lifting end of the tab. Generally, a channel depth of from about 5 to 30 mils is sufficient for an effective pressure relief or free lift for finger purchase. The appropriate channel depth for particular containers is, among other factors, dependent upon the shape of the pushing end of the tab, the distance between stacked container tops, and the amount of residual force available to the tab after pressure relief. A too shallow depth is ineffective in permitting free lift of the lifting end of the tab for a full finger purchase. An excessively deep channel may result in vaulting of the tab over its pushing position without opening of the container, i.e. insufficient remaining pushing force to open the scored section. In addition, excessive depth results in a channel bottom protrusion which interferes with container top stacking, i.e. "sponging", which interferes with proper container top feeding during high speed production. A channel depth of from 10–15 mils is therefore preferred for most applications.

In order to allow the lift tab to enter the channel without significant resistance, i.e., to reduce lift pressure, the top edge of the channel wall, of the two opposing channel walls, closest the lift tab is bevelled or rounded to an extent sufficient to permit substantially unimpeded movement of the lift tab end into the channel.

The pushing end of presently commercially available lift tab designs is one of three general types and the channel of the present invention is configured and dimensioned into conformity with the specific tab being utilized. A first tab pushing end configuration is circular (with a pinched apex for strength) and the relief channel of the present invention is a correspondingly circular arc. A second tab pushing end configuration is wedge shaped with the relief channel being correspondingly shaped to have a wedge formation with a flat base and two extending sides. The third general tab pushing end configuration is substantially straight and the relief channel is correspondingly straight. In all instances, the channel extends through the extended longitudinal axis of the tab, at approximately right angles relative thereto. The ends of the channel extend towards the tab (in a configuration dictated by being fittingly corresponding to the configuration of the tab end) to be roughly concave in facing the tab.

In addition to the channel being configured to accommodate the pushing end of the tab, to which it is adjacent, the depth of the individual channel varies according to the contours of the tab end. Thus, for the present tab designs, the center of the channel, falling on the extended longitudinal axis of the tab has the greatest depth. The sides of the channel leading away from this center become shallower in correspondence to the contours of the tab end whereby, when the tab end is fully inserted in the channel, there is full engagement of the tab end with the container top at the base of the channel. This permits full pressure to be exerted by the pushing end of the tab whereby the scored section can be appropriately opened without excessive concentration of pushing pressure.

The container top channel of the present invention is effected with minimal change of existing forming equipment and requires only an addition to the container top stamping die. However, it is important that subsequent processing of the container top not flatten out the base of the channel. It is accordingly preferred that the channel be stamped or formed at the latter stages of container top production or that its integrity be preserved by flattening blocking means.

DETAILED DESCRIPTION OF THE DRAWINGS AND THE PREFERRED EMBODIMENT

Figure 1:
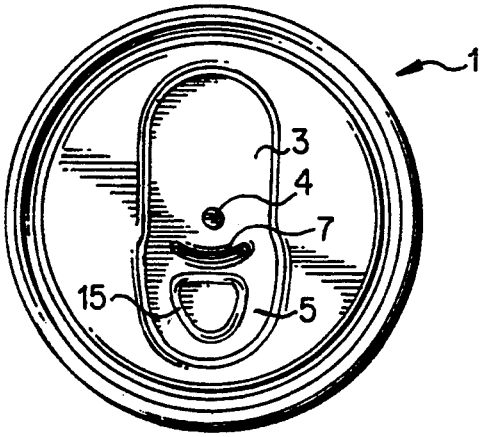
FIG. 1 is a top view of a container top of the present invention, prior to emplacement of a non-detachable fulcrum type lift tab.
Figure 2:
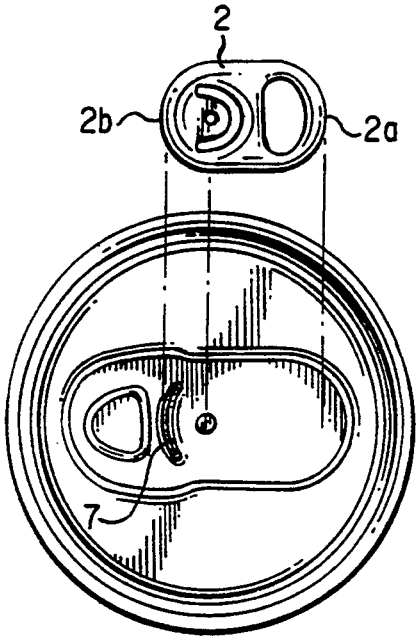
FIG. 2 is an exploded view of the container top of FIG. 1 with a lift opening tab placed thereon.

With specific reference to the drawings, a typical beverage container top 1 is shown, in FIG. 1, prior to emplacement of lift tab 2, and with lift tab 2, being placed thereon in FIG. 2. Rivet section 4, which holds the tab in non-removable position, is located at the center of the top and in the middle of dished portion 3. Rivet section 4 is peened over tab 2 to non-removably hold, on the container top 1, after the container top 1 and tab 2 are brought together. In operation thereafter and as shown in FIG. 3, the area 5, defined by score 15, is opened by the lift tab 2, when it is sufficiently lifted.

In accordance with the present invention, channel section 7 is positioned between the rivet and the scored section 5, directly adjacent the end of the tab 2. As shown in FIG. 2, when tab 2 is emplaced on rivet 4 (which is peened over to prevent removal of the tab from the can top), the pushing end **2*b* thereof, is located adjacent the channel section 7, which corresponds in shape and dimension with such pushing end. As a result, when the lift end 2*a* of tab 2 is initially lifted to open the score area 5 on container 10, as shown in FIG. 3, there is a relatively unimpeded initial movement of the pushing end 2*b* of the tab 2 into the channel 7. This is more clearly seen in FIG. 3*a*. Initial lifting of the tab 2 is thereby facilitated, with opening of the scored area 5 (with lift resistance pressure) being delayed until the pushing end 2*b* engages the base of channel 7**.

As is further more clearly visible in FIG. **3*a*, the channel wall 7*a* is bevelled or rounded from the edge shown in dotted line, whereby the controlled rolling movement of the tab 2, into channel 7, is not impeded by an edge. It is also preferred that edge 7*b* be formed bevelled or rounded to avoid sharp edges on any point of the container 10**.

FIG. 3B depicts a bevelled edge removal **7*a*′, with effect similar to that of the structure shown in 3A**.

In FIGS. **4*a*–4*c*, various tab ends 2*b*′, 2*b*″ and 2*b*‴ are shown with corresponding channels 7′, 7″ and 7‴. Tab end 2*b*′ is substantially rounded with channel 7′ falling on extended longitudinal axis L′ and substantially at right angles thereto. The base of channel 7′ is deepest at the intersection point with the longitudinal axis L′, corresponding to closest point 8 of tab 2′. The ends of channel 7′ are upwardly curved in depth corresponding to engaging portions of tab 2′. Channels 7″ and 7‴ are similarly conformed to respective tabs 2″ and 2‴ in both shape and variation in depths. This is more clearly illustrated in FIGS. 6*a*–*c* and 7*a*–*c***, showing the proximate relationship of the tabs and channels and the depth conformation of the latter.

In FIG. 5, container tops 1 are shown in the stacked feed position, wherein the base of the respective channels 7 are spaced from the next succeeding container top 1, whereby detrimental sponging does not occur.

It is understood that the above drawings and description of preferred embodiment are illustrative of the present invention and changes may be made in the container tops and tabs, such as with relative shapes and configurations and the position of the various elements and the like without departing from the scope of the present invention as defined in the following claims. In addition, while the present invention has been described specifically with respect to container configurations common to beverage container, the invention is similarly applicable to container configurations such as used for food, wherein entire container lids are removed.

What is claimed is:

1. A container comprising a container top and a lift tab non-detachably connected to the container top, wherein said container top has a dished section, of sufficient dimension to accommodate said lift tab therein, said dished section having a flat surface on which said lift tab is positioned in adjacent contact therewith, whereby the lift tab comprises a lifting end and a pushing end, with the lift tab being connected to the container top, between said pushing and lifting ends, whereby lifting of the lifting end causes fulcruming movement of the pushing end into pushing contact with a weakened section of the container top, within the dished section, and opening of the weakened section for access to the container contents, and wherein said pushing end and said lifting end each have lower flat portions which are aligned with each other in a common plane and wherein the lower flat portions of the pushing end and lifting end are each in adjacent contact with the flat surface, with the flat surface also being aligned in said plane, whereby access to and lifting of the lifting end is impeded prior to the opening of the weakened section; the improvement comprising a channel being formed in the container top, directly adjacent said pushing end, with said pushing and being aligned in said plane, and with said channel being positioned and configured such that, upon initial lifting of the lifting end, the pushing end enters into the channel, without impedance, thereby delaying said pushing contact for a distance sufficient to enable the lifting end to be raised, with reduced resistance, to enable finger insertion thereunder for continued lifting and opening of the weakened section, wherein said channel is positioned substantially perpendicularly across a longitudinal axis extending through said lift tab and wherein said channel is congruent with said pushing end, and whereby said channel extends sufficiently away from said axis whereby said pushing end fits into said channel, without impedance, and wherein said channel has a base, with said pushing end coming into substantially complete pushing contact with said base, wherein said channel comprises two opposing walls, with one of said walls being closely adjacent to said tab; and wherein said wall closely adjacent to said tab is formed with a reduced edge with the flat portion to permit said pushing end to enter into the channel without impedance thereby.

2. The container of claim 1, wherein said wall is formed with a beveled edge.

3. The container of claim 1, wherein said wall is formed with a rounded edge.

4. The container of claim 1, wherein the maximum depth of said channel ranges between 5–30 mils.

5. The container of claim 4, wherein the maximum depth of said channel ranges between 10–15 mils.

6. The container of claim 1, wherein said tab has a substantially rounded pushing end and wherein the base of the channel is congruent therewith.

7. The container of claim 1, wherein said tab has a wedged shaped pushing end and wherein the base of the channel is congruent therewith.

8. The container of claim 1, wherein said tab has a substantially straight shaped pushing end and wherein the base of the channel is congruent therewith.

9. The container of claim 1, wherein the other of said two opposing walls, furthest from said tab, is formed without an exposed sharp edge.

* * * * *